United States Patent [19]

Newbegin

[11] 4,158,445

[45] Jun. 19, 1979

[54] APPARATUS FOR CONTINUOUS WINDING OF WEIGHED QUANTITY OF YARN

[75] Inventor: Everett H. Newbegin, Cumberland, R.I.

[73] Assignee: SER Co., Pawtucket, R.I.

[21] Appl. No.: 879,730

[22] Filed: Feb. 21, 1978

[51] Int. Cl.[2] ..... B65H 61/00; B65H 63/08

[52] U.S. Cl. ..... 242/39; 242/49

[58] Field of Search ..... 242/39, 36, 37 R, 49, 242/18 R, 18 DD, 28, 40, 57

[56] References Cited

U.S. PATENT DOCUMENTS

| | | | |
|---|---|---|---|
| 127,456 | 6/1872 | Brown | 242/39 |
| 1,143,003 | 6/1915 | West | 242/39 X |
| 3,693,897 | 9/1972 | Davidson | 242/18 R |
| 3,785,582 | 1/1974 | Girard | 242/39 |

*Primary Examiner*—Stanley N. Gilreath

*Attorney, Agent, or Firm*—Barlow & Barlow

[57] ABSTRACT

A skein winder for winding skeins of pre-weighed yarns is disclosed that includes a balance means which has a first platform to receive the yarn bobbin and a variable restoring force acting on the balance means which variable restoring force may be lightened in predetermined increments. A switch means is responsive to unbalance in one direction to initiate rotation of the skein winding spindle and to unbalance in the other direction to stop winding and also to remove a predetermined quantity of restoring force weight automatically.

6 Claims, 3 Drawing Figures

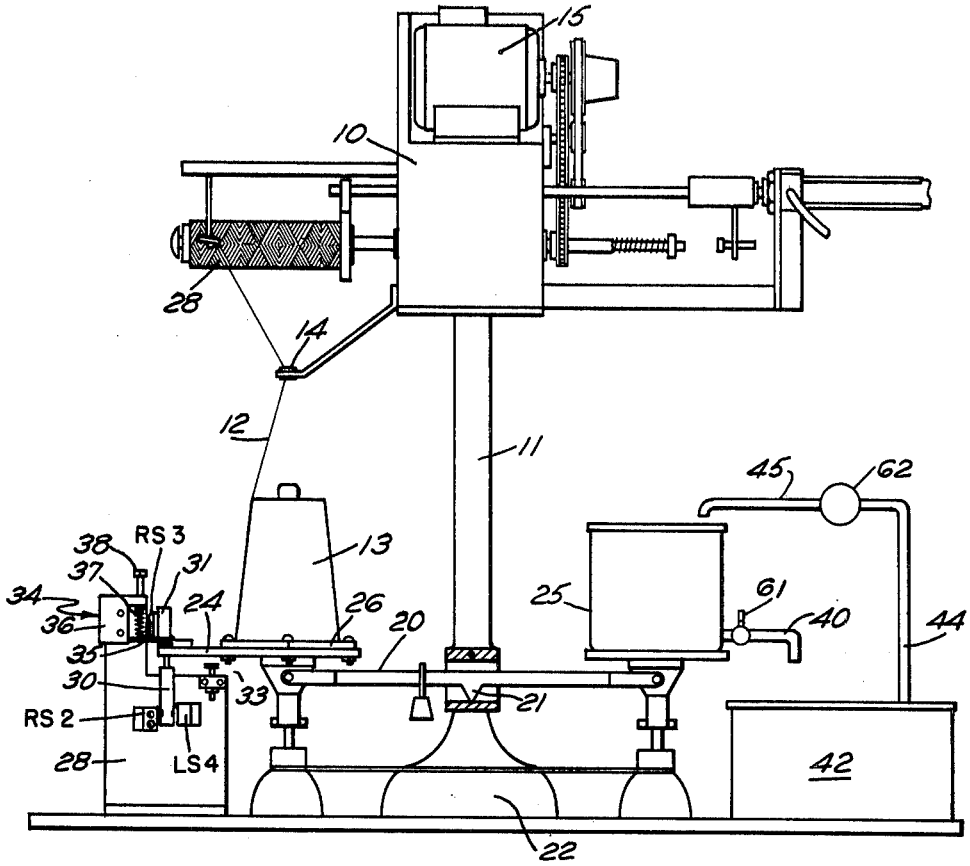
FIG. 1
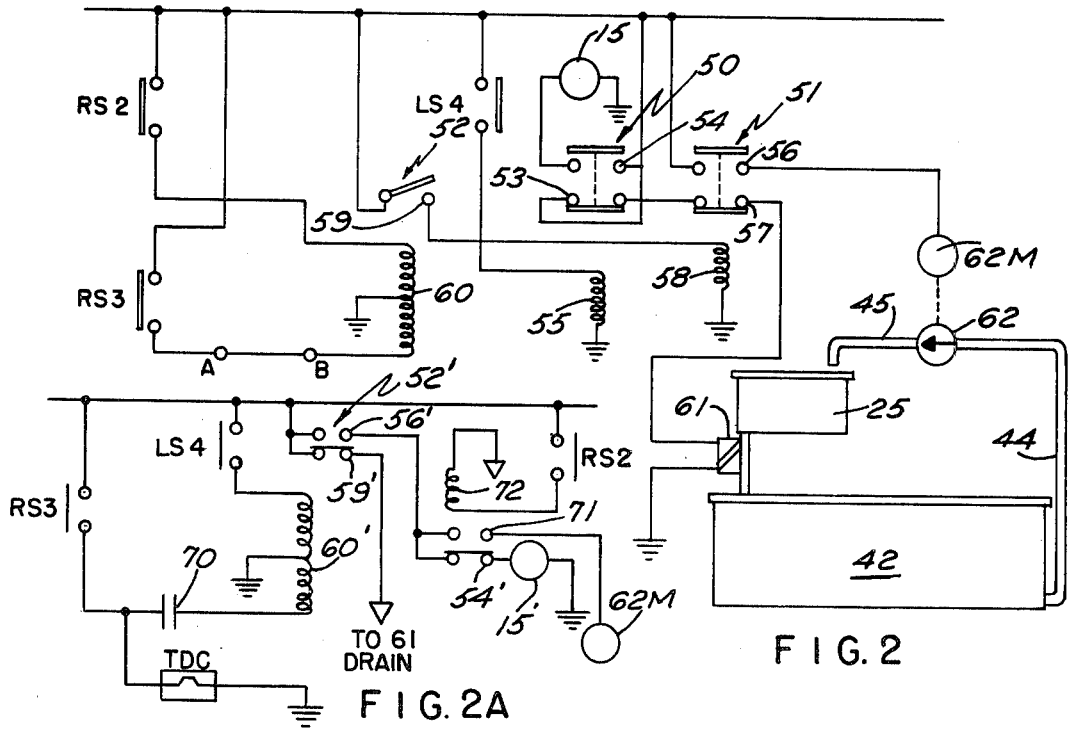
FIG. 2A
FIG. 2

APPARATUS FOR CONTINUOUS WINDING OF WEIGHED QUANTITY OF YARN

BACKGROUND OF THE INVENTION

The present invention relates to the concept of winding skeins of yarn in accurate weight quantities. In the past it has been the practice to wind yarn in skein form for eventual packaging and use as in hand knitting yarn by measuring the length of yarn wound on the skein. Davidson U.S. Pat. No. 3,693,897 is a disclosure of such skein winding apparatus. As can be appreciated, yarn varies in density so that its density in unit length is not uniform and accordingly it becomes a trial and error proposition to ascertain for any given cone of knitting yarn the length that is necessary to produce a package of, let us say, 4 oz. As a result of these shortcomings in winders used in the past, yarn packagers have effectively provided more yarn per package than the weight indicated thereon so that Government consumer inspectors would not penalize the distributor for an underweight package. Some prior attempts have been made in which weighing apparatus has been used as, for example, in the West U.S. Pat. No. 1,143,003 and in a Girard U.S. Pat. No. 3,785,582. In each of these prior art attempts, however, weights are used as a restoring force on the beam balance and must be manually removed from the beam balance for even wind. This is not desirable in automated skein winding machines.

SUMMARY OF THE INVENTION

The present invention overcomes the aforementioned shortcomings by providing an apparatus for weighing yarn that is delivered to a winding machine which is achieved by the utilization of the principle of a balance beam, one side of which supports a cone or bobbin of yarn and the other side of which supports a restoring force in the form of a liquid container, the arrangement being such that the liquid container will draw off a sufficient amount of liquid to compensate for the yarn removed which in turn re-establishes balance for the winding of successive skeins of yarn and includes the combination of a winding machine and the weighing machine whih operate conjointly with switch sensing means that are coupled to the balance beam.

DESCRIPTION OF THE DRAWINGS

FIG. 1 is a diagrammatic elevational view of a skein winder with an automatic weighing apparatus associated therewith;

FIG. 2 is an electrical schematic showing how the apparatus operates;

FIG. 2A is an electrical diagram of an alternate for the circuit.

DESCRIPTION OF THE PREFERRED EMBODIMENT

A skein winding machine can take a variety of forms, there being a well known multiple winding machine known as a Model 50 Universal Winder which is generally illustrated in U.S. Pat. No. 801,941 as well as a winder such as shown in U.S. Pat. No. 3,693,897, the latter of which is depicted in FIG. 1 of the drawings. Referring to FIG. 1 it will be noted that for convenience of illustration a skein winder as shown in the Davidson U.S. Pat. No. 3,693,897 has been illustrated. Basically this skein winder consists of a mechanism housing 10 that is supported on a suitable post 11. Yarn

12 is taken from a supply bobbin or cone 13 through a guide eye 14 and thence to the winding spindle 28. The spindle 28 is rotated by a mechanism within the winder that is basically driven by a motor 15. The details of the winding operation need not be repeated, and the disclosure in the aforementioned Davidson U.S. Pat. No. 3,693,897 are hereby incorporated by reference.

Associated with the skein winder is a device to accurately measure a predetermined weight quantity of yarn. It consists basically of a balance beam 20 as shown in FIG. 1 that is centrally supported on a fulcrum 21 that rests on a suitable center support means 22. One end of the beam has affixed thereto a platform 24 while the opposite end of the beam supports a fluid retaining tank 25.

Associated with the first platform 24 is a suitable bracket 26 for holding a bobbin or cone in position and also a support plate 28 is mounted adjacent thereto. The support plate 28 has affixed thereto a switch RS2 and LS4, both of which are mounted below the platform while a third switch RS3 is mounted above the platform. Each of these switches is preferably magnetically actuated switch, such as a reed switch, and the first two mentioned switches are controlled by a magnet 30 that is carried by the platform 24, while the third switch is controlled by a magnet 31 also carried by the platform 24 on the upper side thereof. Other switching means may be used such as photo electric cells and similar devices. In addition, the support 28 includes a lower limit stop stud 33 and an adjustable force device generally designated 34. The device 34 consists of an arm 35 that extends pivotally from a mounting block 36, the arm being urged by a light spring 37, the compression of which is adjustable by a stud 38, against the upper edge of the platform 24. The device provides fine adjustment of the balance device as will presently be described.

The container 25 that is mounted on the other end of the beam balance 20 has a drain tube 40 extending therefrom with a drain valve 61 controlling the flow. Assuming the yarn and container are in balance, the drain valve 61 is a solenoid valve which will operate until unbalance is reestablished, as will presently appear, each time the valve is electrically actuated. There will be drawn off in weight of fluid such as water the amount of yarn weight that there is to be drawn off the yarn supply 13. The drain line 40 directs liquid into a reservoir 42 and from this reservoir there extends a return conduit 44 that goes to a pump 62 and thence conduit 45 leads to the container 25.

As will be seen from the foregoing description, one side of the beam balance on which the yarn cone is mounted has two switch means sensitive to the low positions of that part of the beam balance, switch RS2 being lower than switch LS4. One switch RS3 is sensitive to the up position of the same end of the beam balance. Also each of the switches is a normally open contact switch, and the circuit that is utilized is exemplary of utilizing normally open contact switches and particularly switches sensitive to magnetic actuation such as magnetic reed switches.

Turning now to the circuit diagram, FIG. 2, three relays generally designated 50, 51 and 52 are provided. Relay 50 has a set of normally closed contacts 53 and a set of normally open contacts 54, all under the actuation of a coil 55. Relay 51 has a set of normally open contacts 56, a set of normally closed contacts 57 and an actuator coil 58, while relay 52 has a set of normally open mechanically latching contacts 59 and a double wound coil 60 so that relay 52, in effect, operates as a latching relay, which is bistable. The circuit is relatively simple, and an understanding of the operation of the device will clarify the circuit description.

It must be kept in mind that the device is intended to work in an unbalanced condition. The yarn supply 13 will be heavier than weight 25. Let us assume, therefore, that the beam is in unbalance in which condition switch LS4 is actuated which energizes solenoid coil 55, closing contacts 54 which start the winder motor 15 and opening contacts 53 which de-energizes drain valve 61 closing the same. The winder motor will now wind and as it is winding yarn off, the lefthand side of the beam balance will become lighter and will raise, and as soon as the magnet gets out of range of LS4, LS4 will open, stopping the motor that is winding the yarn. The beam will be substantially in balance and switch RS3 will close opening relay 52 and making a circuit through contacts 53 and 57 to open drain valve 61 which now will attempt to reestablish unbalance. The winder at this point will cut and doff the yarn, for example, as disclosed in the aforementioned Davidson patent. Once unbalance is reestablished, switch LS4 closes again, and the cycle is repeated until the cone is empty.

When a new cone is placed on platform 26, the platform will extend down a considerable distance and energize lowermost switch RS2, which closes contact 59 in a latched condition that in turn energizes relay 51, insuring that the drain solenoid is closed and energizing motor 62M that is coupled to a fluid return pump 62. This now fills the container 25 with sufficient liquid so that the beam balance will be effectively at near balance overswing and switch RS3 will be actuated opening relay 52 which also opens relay 51. Drain valve 61 opens and reestablishes unbalance, switch LS4 being actuated to start the winder and the cycle is repeated. The adjustable force device 34 can control the weight of yarn wound by acting similar to a balance weight. Thus the stud 38 can compress its spring 37 that through arm 35 establishes a force on the balance platform 24 which will adjust the amount of yarn by retarding the raising of platform 24.

Turning now to the circuit diagram FIG. 2A, an alternate electrical control circuit has been illustrated with some of the parts eliminated which were previously shown in FIG. 2. Basically in this arrangement adjustable weight control is achieved electrically, that is, without the device 34, and in essence is created by inserting a variable timed delay relay device in series with switch RS3. It will be noted the timed delay relay has a contactor 70 which is in series with one half of the double wound coil 60'. The other side of the double wound coil 60' is in series with switch LS4. In this embodiment the relay 52' has a set of normally closed and normally open contacts 59' and 56', respectively, contacts 59' being in a serial connection to the drain solenoid 61 as indicated by the legend and contacts 56' being in serial relationship with a set of normally open contacts 71 that lead to the pump motor 62M and a set of normally closed contacts 54' that lead to the winder motor 15'. These latter two sets of contacts are under control of a relay coil 72 that is in series with switch RS2.

In operation, it will be apparent that the relay 52' controls respectively the drain solenoid and the winding motor 15'. Assuming, therefore, that yarn is being drawn off with the winding motor operative in which case the switch LS4 has been engaged and has moved the contactor to close contacts 56', the yarn will be drawn of until the switch RS3 is actuated. However, in order to get fine adjustment when the switch RS3 closes, the time delay relay TDC is actuated and after a preset delay, it closes its contactor 70 which now energizes coil 60' and on requisite delay operates relay 52', opening contacts 56' stopping motor 15', closing contacts 59' which opens the drain valve solenoid. As soon as the beam comes into unbalance again, switch LS4 closes and re-starts the cycle. This will continue until the yarn has been completely drawn off and at that time there will be sensing means on the winder indicating a no yarn condition stopping all of the apparatus. When a new cone is placed on the beam balance, it will extend the platform 24 down far enough so that switch RS2 is engaged, and when that occurs, this actuates a contact 71 opening normally closed contacts 54' so that the winder cannot start up and pump 62M refills the reservoir, it being appreciated that in this scheme the point at which the winder stops can be finally controlled by varying the timed delay that affects the closure of switch RS3 without moving the switch to a new position.

I claim:

1. In combination a skein winder having a rotatable spindle, means rotating said spindle, a balance means having a first platform to receive a yarn bobbin from which yarn is led to said spindle, a restoring force acting on said balance means, said force including a variable fluid weight, means removing a predetermined quantity of fluid weight corresponding to the desired weight of a skein, first switch means responsive to unbalance to close and initiate rotation of the spindle, second switch means responsive to balance to stop spindle rotation and initiate liquid removal of a predetermined quantity of liquid until unbalance actuates said first switch means.

2. A combination as in claim 1 wherein the liquid weight means includes a container mounted on the balance means and a reservoir to receive liquid with means to selectively fill said container from said reservoir.

3. A combination as in claim 2 wherein third switch means are provided that actuate when a new full yarn bobbin is placed on the first platform, said third switch energizing the filling means.

4. In combination a skein winder having a rotatable spindle, means rotating said spindle, a balance means having a first platform to receive a yarn bobbin from which yarn is led to said spindle, a restoring force acting on said balance means, said force including a variable fluid weight, means removing a predetermined quantity of fluid weight corresponding to the desired weight of a skein, means responsive to unbalance of said balance means to initiate rotation of said spindle and after a predetermined amount of yarn is unwound from said yarn bobbin and balance is established stop said spindle and initiate fluid weight removal until unbalance occurs and initiation of said rotation of said spindle again occurs.

5. In combination a skein winder having a rotatable spindle, means rotating said spindle, a balance means having a first platform to receive a yarn bobbin from which yarn is led to said spindle, a restoring force acting on said balance means, said force including a variable fluid weight, means removing a predetermined quantity of fluid weight corresponding to the desired weight of a skein, first switch means responsive to unbalance to intiate rotation of the spindle and to open responsive to balance, second switch means responsive to balance to initiate liquid removal of a predetermined quantity of liquid until unbalance actuates said first switch means.

6. A combination as in claim 5 wherein means are connected to said balance means to establish a variable force thereon.

* * * * *